US007600899B2

(12) United States Patent
Chen

(10) Patent No.: US 7,600,899 B2
(45) Date of Patent: Oct. 13, 2009

(54) RECESSED LAMP STRUCTURE

(76) Inventor: Yen-Chang Chen, No. 4, Alley 10, Lane 1, Pao An Street, Sec. 3, Shu Lin, Taipei Hsien (TW)

( * ) Notice: Subject to any disclaimer, the term of this patent is extended or adjusted under 35 U.S.C. 154(b) by 336 days.

(21) Appl. No.: 11/790,474

(22) Filed: Apr. 25, 2007

(65) Prior Publication Data

US 2008/0266883 A1 Oct. 30, 2008

(51) Int. Cl.
*F21V 15/00* (2006.01)

(52) U.S. Cl. ..... 362/366; 362/371; 362/269; 362/275; 362/287; 362/419; 362/427; 362/365; 362/369; 362/364

(58) Field of Classification Search ..... 362/366, 362/364, 365, 369, 370, 371, 393, 269, 275, 362/287, 419, 427, 362
See application file for complete search history.

(56) References Cited

U.S. PATENT DOCUMENTS 6,481,871 B2 * 11/2002 Jamison ..... 362/287
6,543,915 B1 * 4/2003 Chen ..... 362/427
7,311,422 B1 * 12/2007 Chen ..... 362/364
2007/0019418 A1 * 1/2007 Czech et al. ..... 362/364
2007/0103913 A1 * 5/2007 Lin ..... 362/362

* cited by examiner

*Primary Examiner*—Sandra L O'Shea
*Assistant Examiner*—Jessica L McMillan
(74) *Attorney, Agent, or Firm*—Troxell Law Office PLLC

(57) ABSTRACT

A recessed lamp structure comprises: a lamp bulb, a lamp holder, a rotatory carrier and an outer mounting base. The rotatory carrier is securely screwed onto a track frame, which has a hollow sliding slot on the center of the bended body thereof. The track frame is securely positioned on the axially connecting base of the rotatory carrier via two axial plates that locate on the rearward of the track frame. The lamp holder is rotatably coupled with the rotatory carrier by two bolts. The bolts are mounted in the limited connection space between the lamp holder and the rotatory carrier. Besides, the lamp holder is shiftable along the sliding slot for adjusting the lighting angle within approximate 70 degrees. Consequently, the recessed lamp structure of the present invention has simplified components and is easy to practice.

1 Claim, 7 Drawing Sheets

RECESSED LAMP STRUCTURE

FIELD OF THE INVENTION

The present invention relates to a recessed lamp structure, and more particularly to a recessed lamp structure that has a lamp holder for insertion thereinto of a lamp bulb of different lengths so that the lamp holder is smoothly shiftable along a sliding slot for changing the lighting angle.

BACKGROUND OF THE INVENTION

As disclosed in U.S. patent application. No. Ser. 11/482,742, filed on 2006 by the present inventor, a rotatory carrier 3 has a coupling base 31 and a fixing base 32 disposed oppositely on the backside of the rim thereof. Two paired lateral arms 33 are disposed bilaterally on the rotatory carrier 3. A track frame 35 is fixed on the coupling base 31 and the fixing base 32. A sliding slot 351 is formed on the upper portion of the track frame 35, and the front end of the track frame 35 is fixed on the coupling base 31 of the rotatory carrier 3. The track frame 35 is securely screwed on the fixing base 32 via fixing plates 352 that locates on the rearward of the track frame 35. Rotation shafts 36 are securely coupled with the coupling portions 23 on the rearward of a lamp holder 2 so that the lamp holder 2 is axially positioned on the track frame 35 by the rotation shafts 36 so as to axially fix the lamp holder 2 on a rotatory carrier 3.

The lamp bulb is coupled with the inside of the lamp holder in such a manner that the lamp holder has a smaller rotation radius. Accordingly, the lamp bulb has a smaller rotation angle, and the lamp holder is not adaptable for the lamp bulb that has a longer length. What is needed is an improvement which overcomes these and other shortcomings.

SUMMARY OF THE INVENTION

It is an object of the present invention to provide a recessed lamp structure that utilizes the space effectively for axially connecting the lamp holder with the rotatory carrier so that the rotation radius of the lamp holder can be increased. Such structure enables the lamp bulb to be mounted and the lighting angle to be adjusted effectively.

It is another object of the present invention to provide a simple and simplified recessed lamp structure, wherein the lamp holder, the rotatory carrier and the track frame are all fixed by the same bolts. Consequently, the recessed lamp structure has a more simple design which makes it easier for assembly.

DETAILED DESCRIPTION OF THE PREFERRED EMBODIMENT

Figure 1:
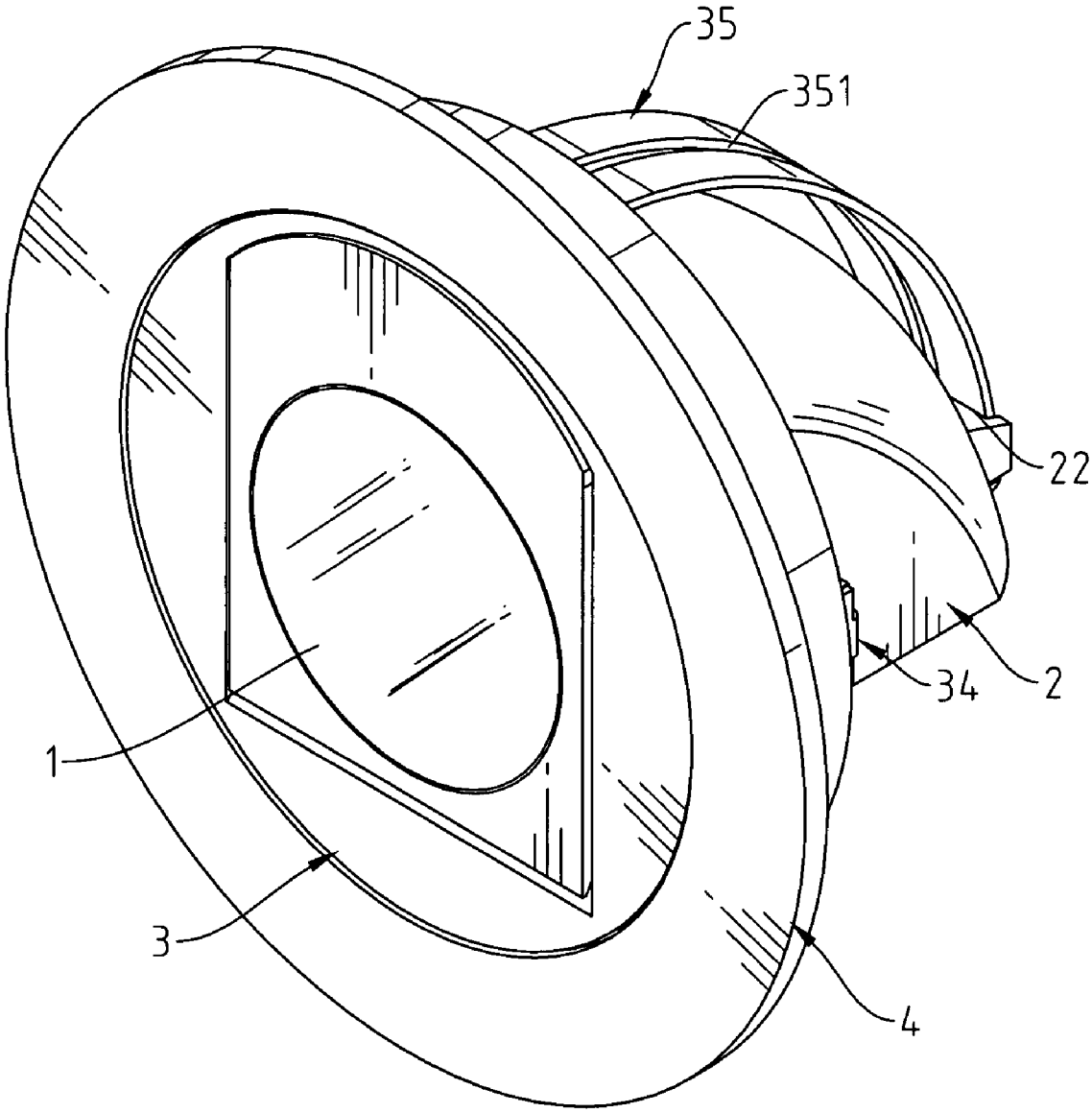
FIG. 1 is an elevational view of the present invention.

Referring to FIG. 1 through FIG. 5, a recessed lamp structure of the present invention generally comprises a lamp bulb 1, a lamp holder 2, a rotatory carrier 3, and an outer mounting base 4. The lamp bulb 1 is insertably coupled with a reception head 21 mounted inside the lamp holder 2, wherein the reception head 21 is fixed on the inside of the lamp holder 2 and designed for holding the lamp bulb 1. In addition, the lamp holder 2 further has a runner base 22 and two coupling means 23 disposed oppositely on upper and lower locations of an opening that forms on the rearward of the lamp holder 2. As a result, the lamp holder 2 is rotatable between the rotatory carrier 3 and the outer mounting base 4 by coupling with the rotatory carrier 3.

The lamp holder 2 is pivotally disposed in the rotatory carrier 3 for adjusting the lighting angle. The rotatory carrier 3 has a coupling base 31 and an axially connecting base 32 disposed oppositely on the front and the back of the rim thereof. Two paired lateral arms 33 are disposed bilaterally on the rotatory carrier 3. Two insertion means 34 are fixed on the top portions of the lateral arms 33, respectively. A retaining plate 341 is protrudent from one of the insertion means 34. The coupling base 31 and axially connecting base 32 that locate on the rearward of the rotatory carrier 3 are designed for holding a track frame 35.

The track frame 35 is bended about 90 degrees. A sliding slot 351 is formed on the bended portion of the track frame 35, and the front end of the track frame 35 is fixed on the coupling base 31 of the rotatory carrier 3. The track frame 35 and the lamp holder 2 are securely, axially screwed on the axially connecting base 32 by inserting two bolts 36 respectively into two axial plates 352 of the track frame 35, these two coupling means 23 of the lamp holder 2 and two axially connecting parts 321 of the axially connecting base 32 so that the lamp holder 2 is angle-rotatable by adopting the axially connecting parts 321 as pivots.

Referring again to FIGS. 2 and 4, the outer mounting base 4 is sleeved on the outside of the rotatory carrier 3 to enable the rotatory carrier 3 to lean on an annular slot 41 located on the inner edge of the outer mounting base 4 such that the rotatory carrier 3 is 360-degree rotatable by using the insertion means 34 of the lateral arms 33 of the rotatory carrier 3.

Figure 2:
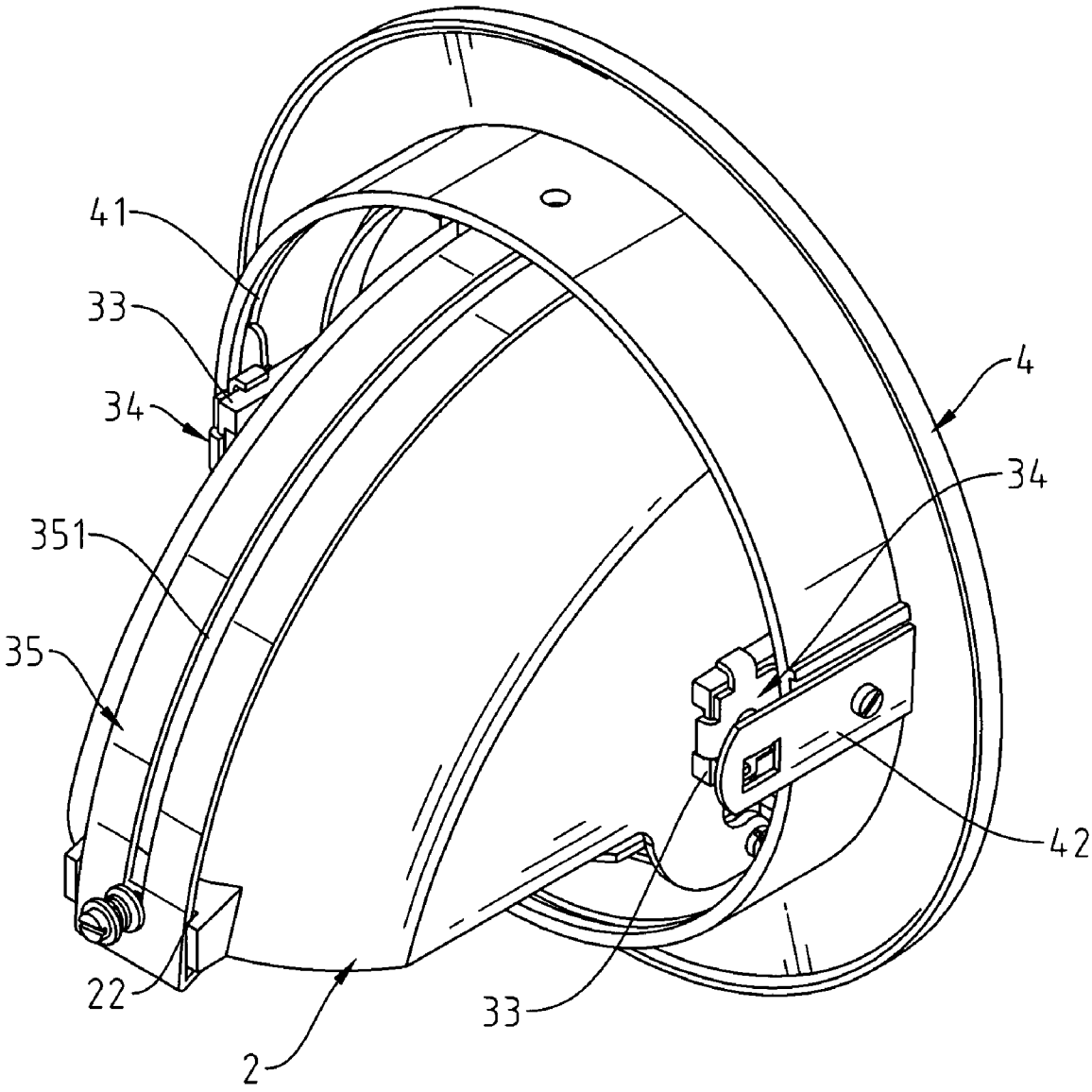
FIG. 2 is another elevational view of present invention taken from another direction.
Figure 3:
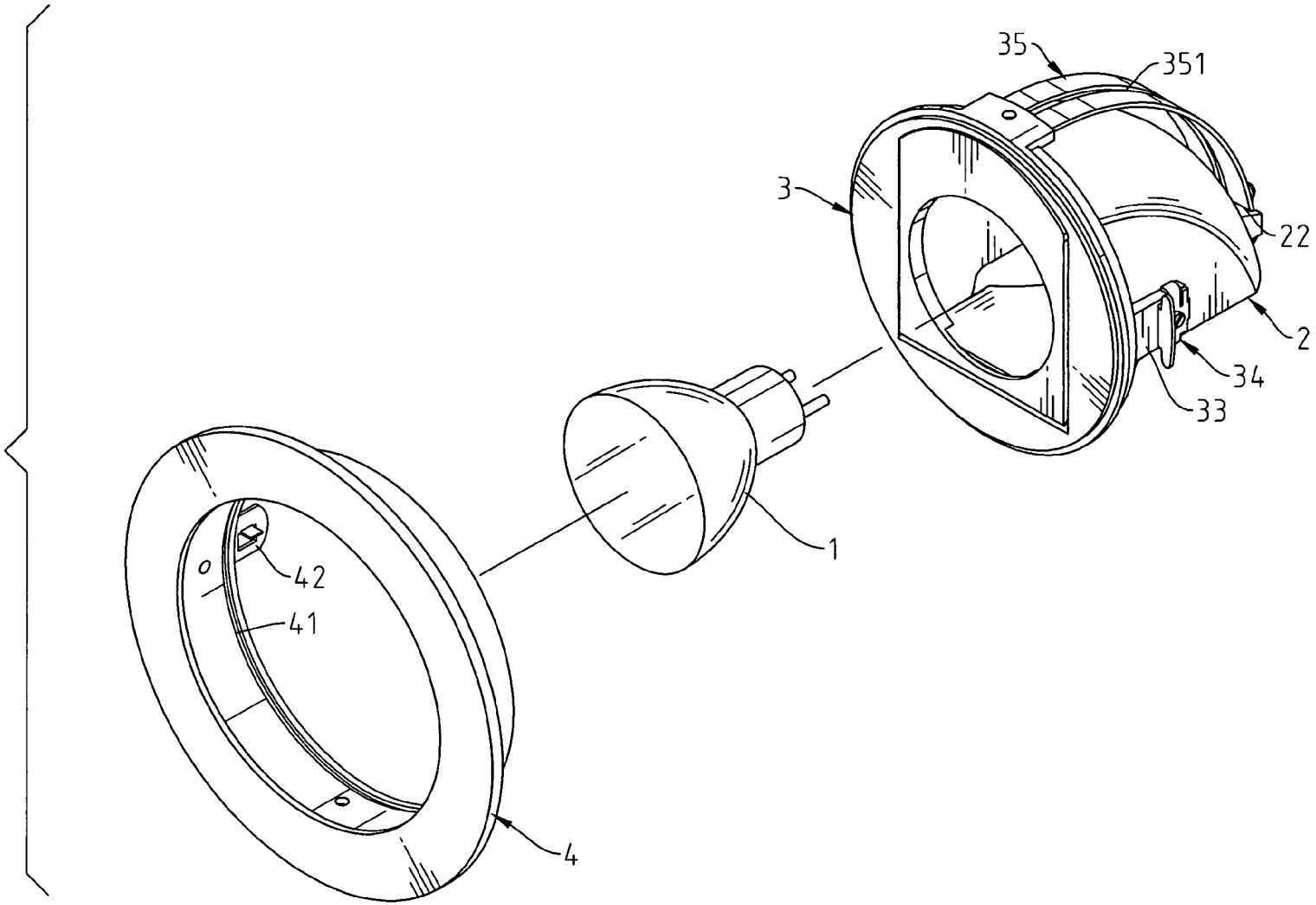
FIG. 3 is schematic, exploded view of the present invention.
Figure 6:
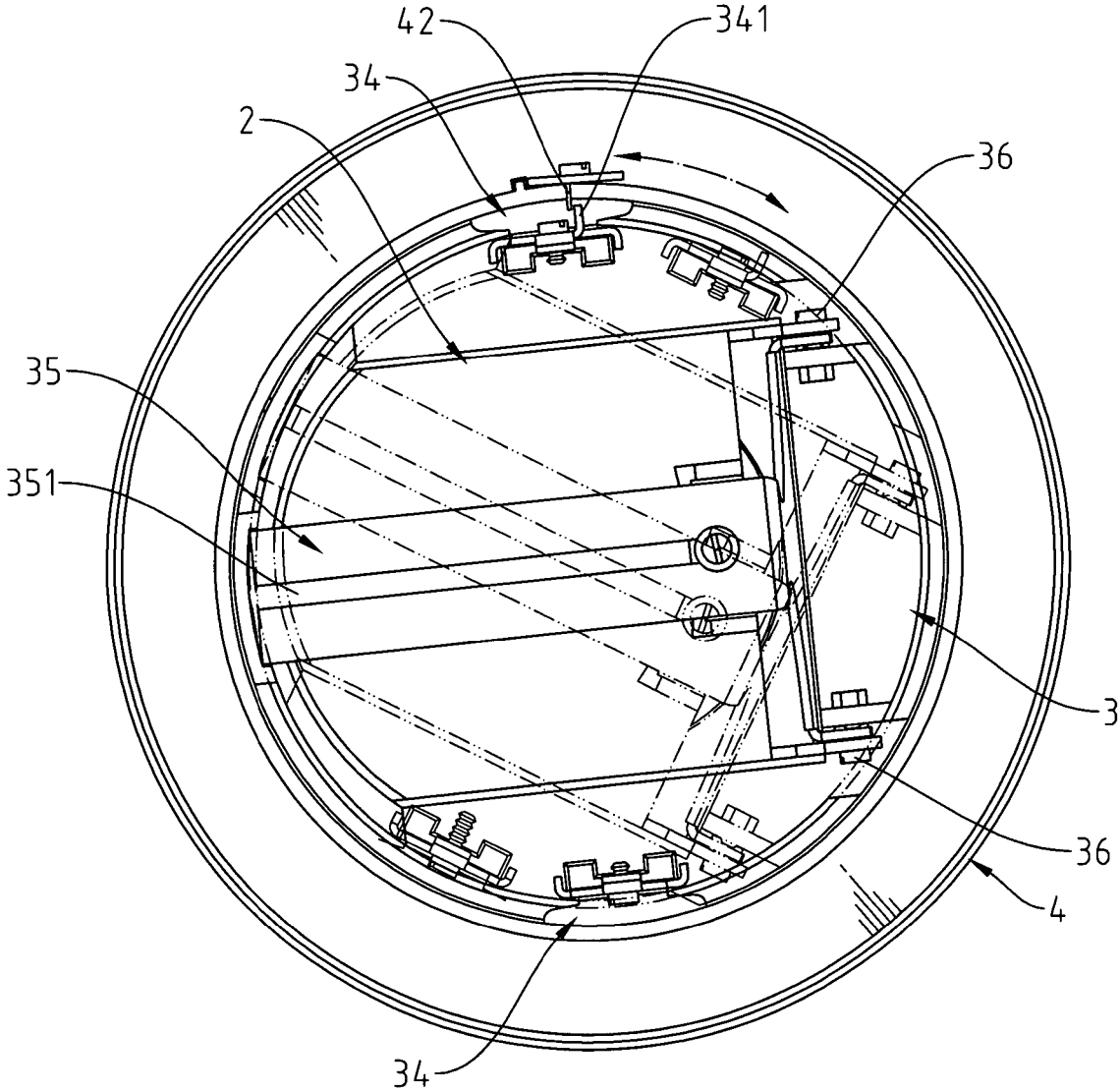
FIG. 6 is a schematic view showing the angular rotation status of the lamp holder of the present invention.

Referring further to FIG. 2 and FIG. 6, a retaining device 42 is securely riveted on the annular slot 41 of the outer mounting base 4. As a result, in the assembly process, the rotatory carrier 3 can be directly disposed on the annular slot 41 of the outer mounting base 4 for rotation such that the retaining plate 341, which is protrudent from one of the insertion means 34, can be retained by slightly leaning against the retaining device 42 for limit control. Accordingly, the rotatory carrier 3 is accurately, completely fastened and positioned on the outer mounting base 4 and is rotatable without the risk of fall.

Figure 4:
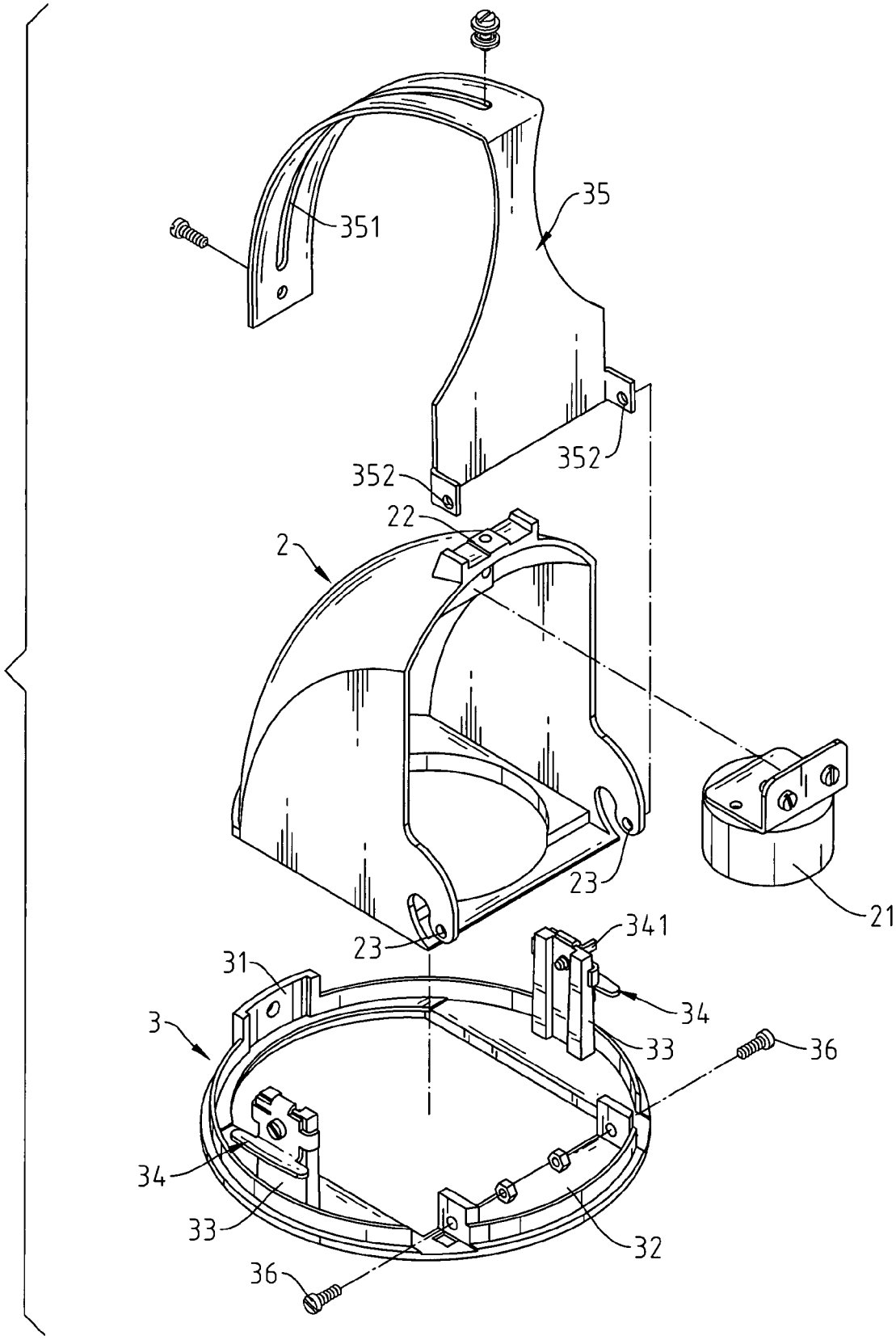
FIG. 4 is an elevational, exploded view showing the lamp holder and the rotatory carrier of the present invention.
Figure 5:
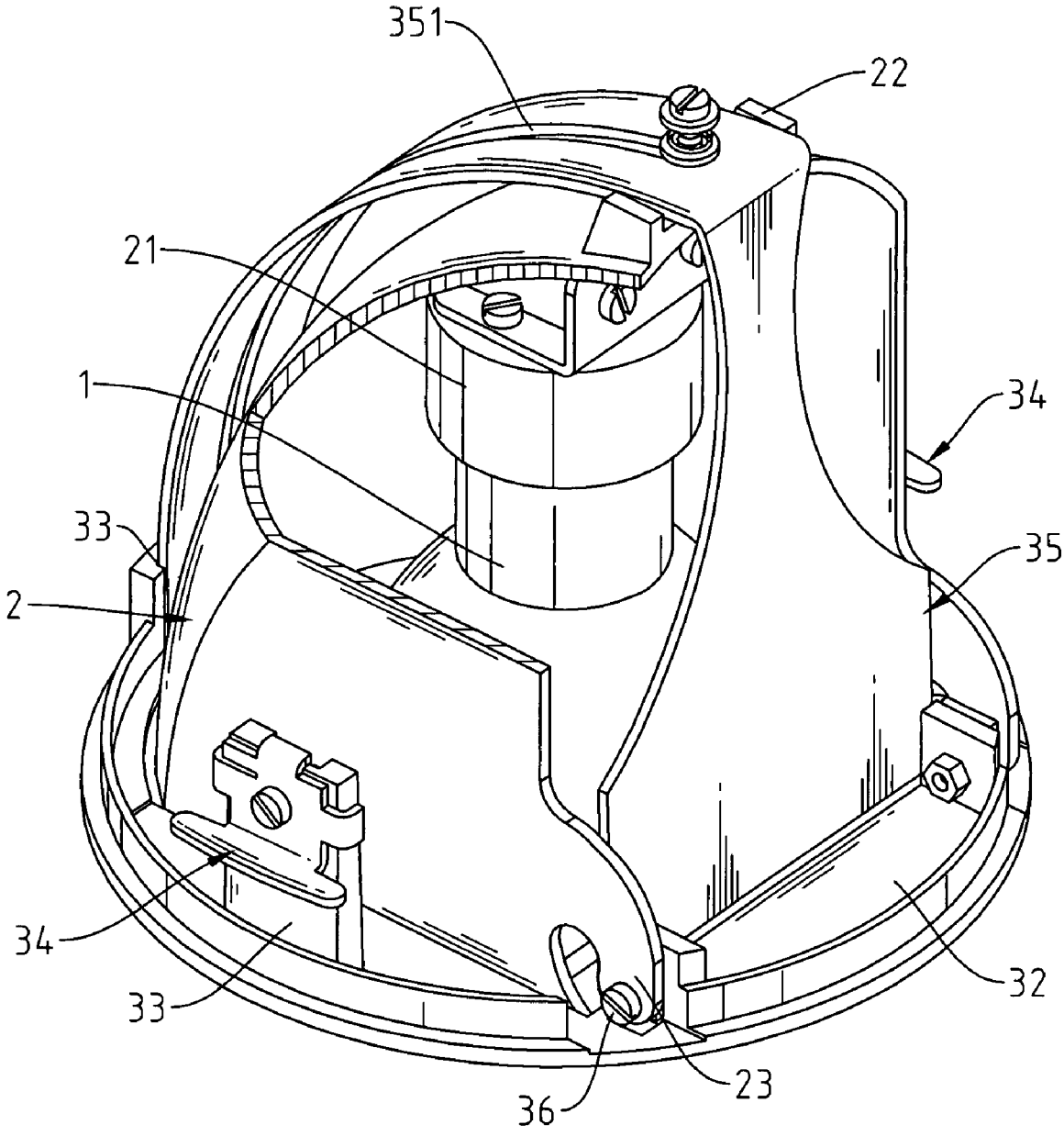
FIG. 5 is a partial, cross-sectional, assembled view of the present invention.
Figure 7:
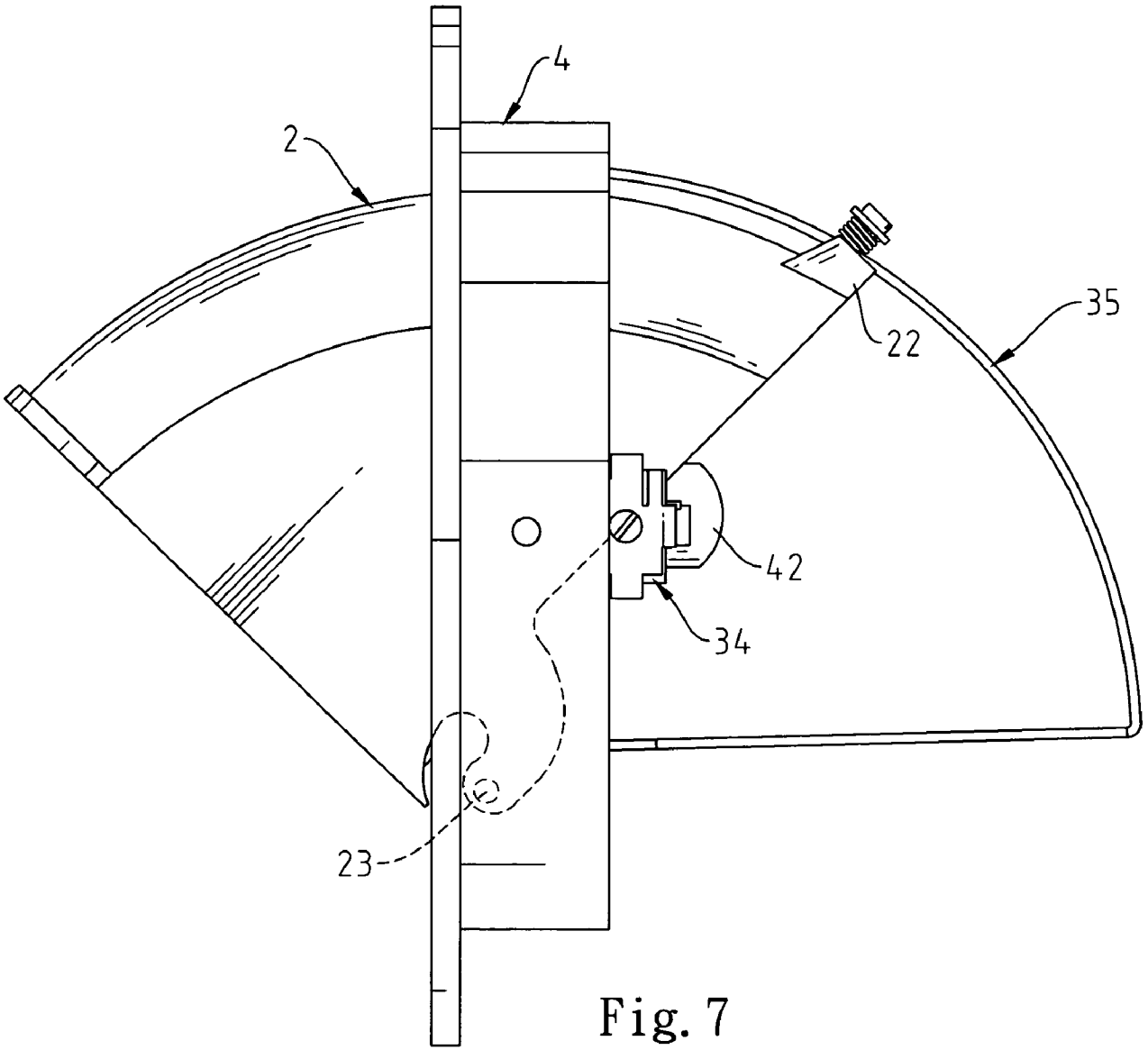
FIG. 7 is an elevational view showing the action of changing the lighting angle of the present invention.

Referring continuously to FIG. 4 and FIG. 7, the track frame 35 is processed to have an integrally extended arc-shaped body on the top. In addition, the track frame 35 has the hollow sliding slot 351 on the center of the arc-shaped body for coupling with the runner base 22 of the lamp holder 2. As a result, the axial connection between the lamp holder 2 and the rotatory carrier 3 is extended to the rear lower portion of the lamp holder 2 so as to increase the rotation radius of the lamp holder 2 effectively and improve the adjustment of the lighting angle effectively. Besides, the lamp holder 2 is shiftable along the sliding slot 351 for adjusting the lighting angle over a large range.

According to the foregoing description, the lamp holder of the present invention is axially connected with the rotatory carrier in a valid space so as to increase the rotation radius of the lamp holder. In such condition, the disposition of the lamp bulb and the adjustment of the lighting angle of the lamp bulb can be both improved effectively. Besides, the lamp holder, the rotatory carrier and the track frame are all fixed by the same bolts such that the mold design can be more simplified and the production cost can be comparatively reduced, whereby the complicated conventional assembling process and the components can be simplified. Consequently, the recessed lamp structure of the present invention is easy to practice.

What the invention claimed is:

1. A recessed lamp structure comprising: a lamp bulb, a lamp holder, a rotatory carrier, and an outer mounting base, wherein said lamp bulb is fixedly coupled with the inside of said lamp holder by insertion into a reception head mounted inside said lamp holder, and said lamp holder further has a runner base and two coupling means disposed oppositely on upper and lower locations of an opening that forms on the rearward of said lamp holder so that said lamp holder is rotatable between said rotatory carrier and said outer mounting base by coupling with said rotatory carrier, wherein said rotatory carrier comprises: a coupling base and an axially connecting base disposed oppositely on the front and the back of the rim thereof; a pair of bilaterally disposed lateral arms; two insertion means fixed on respective top portions of said lateral arms; a retaining plate protrudent from one of said insertion means; and a track frame, wherein said insertion means are rotatably inserted into an annular slot located on the inner edge of said outer mounting base and said track frame is bended about 90 degrees, wherein said track frame has a sliding slot formed on the bended portion, the front end of said track frame is fixed on said coupling base of said rotatory carrier, wherein said track frame has two axial plates on the rearward to be securely screwed onto two axially connecting parts of said axially connecting base, and said axial plates and said coupling means of said lamp holder are penetrated through by two bolts to be axially coupled with said axially connecting parts so as to increase the rotation radius of said lamp holder.

* * * * *